US005387168A

United States Patent [19]

Bostic

[11] Patent Number: 5,387,168

[45] Date of Patent: Feb. 7, 1995

[54] STABILIZING BELT FOR CROSS-COUNTRY SKIING EXERCISE APPARATUS

[75] Inventor: James R. Bostic, Watertown, Minn.

[73] Assignee: NordicTrack, Inc., Chaska, Minn.

[21] Appl. No.: 990,883

[22] Filed: Dec. 16, 1992

[51] Int. Cl.[6] ..... A63B 69/18

[52] U.S. Cl. ..... 482/70; 482/139

[58] Field of Search ..... 482/70, 71, 134, 51, 482/10, 66, 67, 69, 74, 139; 128/25 R; 434/253

[56] References Cited

U.S. PATENT DOCUMENTS

| | | | |
|---|---|---|---|
| 219,439 | 9/1879 | Blend | 482/70 |
| 1,766,089 | 6/1930 | Wood . | |
| 1,975,382 | 10/1934 | Wrobley | 272/57 |
| 3,408,067 | 5/1966 | Armstrong | 272/16 |
| 3,591,172 | 7/1971 | Hude | 272/57 |
| 4,489,936 | 12/1984 | Dal Monte | 482/139 |
| 4,960,276 | 10/1990 | Feuer et al. | 272/97 |
| 5,031,898 | 7/1991 | Anthony | 482/70 |
| 5,158,510 | 10/1992 | Lemire | 482/51 |
| 5,192,257 | 3/1993 | Panasewrez | 482/70 |

FOREIGN PATENT DOCUMENTS

| | | | |
|---|---|---|---|
| 672583 | 10/1963 | Canada . | |
| 1533710 | of 0000 | U.S.S.R. . | |
| 0560622 | 6/1977 | U.S.S.R. | 482/70 |
| 1567230 | 5/1990 | U.S.S.R. | 482/70 |

OTHER PUBLICATIONS

Popular Science—"Ski Treadmill", Oct. 1981 Popular Science p. 80.

*Primary Examiner*—Stephen R. Crow

*Attorney, Agent, or Firm*—Merchant, Gould, Smith, Edell, Welter & Schmidt

[57] ABSTRACT

The present invention provides a pelvis stabilizing device for a cross-country skiing exercise apparatus. The device includes a pelvis support and a belt that are effectively secured relative to a cross-country skiing machine. A person using the machine leans forward against the pelvis support and secures the belt around his or her posterior. The belt essentially stabilizes the person's pelvis relative to the pelvis support.

9 Claims, 3 Drawing Sheets

STABILIZING BELT FOR CROSS-COUNTRY SKIING EXERCISE APPARATUS

FIELD OF THE INVENTION

The present invention relates to exercise equipment and more particularly, to a pelvis stabilizing device for cross-country skiing exercise apparatus.

BACKGROUND OF THE INVENTION

Once a person makes a decision to exercise regularly, he or she faces a second, arguably more difficult decision among all of the available types and brands of exercise equipment. Among the factors to be considered are user friendliness and quality of the workout provided by various apparatus. In this regard, cross-country ski machines are known to provide a very high quality aerobic workout, exercising both the arms and the legs, but such machines may, at first impression, intimidate persons who do not cross-country ski, or who have not exercised for some time, or who are not particularly coordinated. As a result, some fraction of would-be exercisers may be predisposed to select a treadmill or stair stepper simply because the exercise motions are more familiar to them. Moreover, even when such people overcome their inhibitions and try a cross-country skiing exercise apparatus, they are likely to be tentative in their approach and in turn, unnecessarily disappointed with their results. Thus, it would be desirable to provide a means for encouraging otherwise reluctant people to try cross-country ski machines and for allowing them to develop their "skiing" technique in a more reassuring and expeditious manner.

SUMMARY OF THE INVENTION

In operating a cross-country ski machine, a person faces toward a hip pad and places a foot on each of two skis. The person leans forward slightly to rest his or her hips against the hip pad, and grasps one of a pair of handles in each hand. The person then begins "shuffling" his or her feet back and forth on the skis. A resistance mechanism provides resistance to rearward movement of the skis, but not to forward movement of the skis. Thus, a person can simply pull the skis forward, but he or she must drive the skis rearward. In order to maintain his or her balance and proper position on the machine, a person leans into the hip pad during rearward thrust of the skis. If a person leans too much into the hip pad and/or allows both feet to travel rearward at the same time, he or she will drift rearward away from the hip pad. The present invention provides a training belt that holds the person's hips firmly against the hip pad until the "skiing" technique is mastered.

The present invention makes it easier for some people to learn how to exercise on cross-country skiing exercise apparatus by alleviating their concerns with learning the "skiing" motions and maintaining their balance. As a result, people who might otherwise be reluctant to use such equipment, or be tentative in doing so, will be reassured by the presence of the belt, and in many cases, such people will master the "skiing" technique more rapidly. Those skilled in the art will recognize these advantages and others upon a more detailed description of a preferred embodiment.

BRIEF DESCRIPTION OF THE DRAWING

With reference to the Figures, wherein like numerals represent like parts throughout the several views.

DETAILED DESCRIPTION OF A PREFERRED EMBODIMENT

Figure 1:
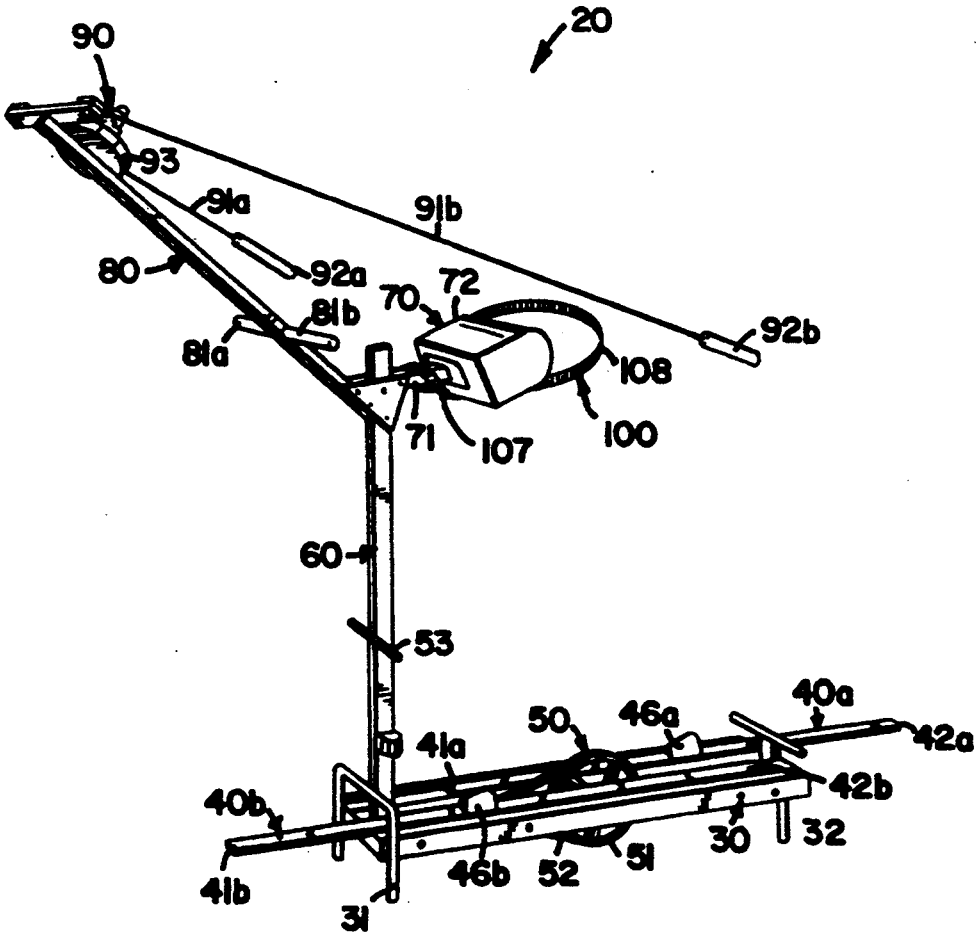
FIG. 1 is a perspective view of a preferred embodiment cross-country skiing exercise apparatus constructed according to the principles of the present invention.

The present invention is directed toward striding exercise apparatus, a representative example of which is designated as 20 in FIG. 1. The cross-country skiing machine 20 is similar to the Prior Art skiing exercise apparatus disclosed in U.S. Pat. No. 4,728,102 to Pauls. To the extent that the Pauls patent facilitates understanding of the present invention, it is incorporated herein by reference.

The exercise apparatus 20 includes a base 30 having a front leg assembly 31 and a rear leg assembly 32 that are designed to rest upon a floor surface. A pair of simulator skis 40*a* and 40*b* are slidably mounted relative to the base 30. Each of the skis 40*a* and 40*b* extends from a respective front end 41*a* and 41*b* to a respective rear end 42*a* and 42*b* and has a respective toe loop 46*a* and 46*b* mounted on a respective intermediate portion therebetween.

Although the simulator skis 40*a* and 40*b* are several times longer than a person's foot, those skilled in the art will recognize that the skis need only be long enough to effectively support a person's foot, and the present invention is not limited in this regard. Indeed, many commercially available striding devices have simulator skis or foot members that are significantly shorter than those shown in FIG. 1. One such Prior Art cross-country skier is disclosed in U.S. Pat. No, 4,650,077 to Stropkay, which is also incorporated herein by reference to the extent that it facilitates understanding of the present invention.

With reference back to the skier 20 shown in FIG. 1, a resistance means 50 is operatively connected to the base 30 and the skis 40*a* and 40*b*, such that the skis 40*a* and 40*b* slide relative to the base 30 subject to resistance provided by the resistance means 50. In a preferred embodiment, the resistance means 50 includes a flywheel 51 that rotates subject to frictional forces between the circumference of the flywheel 51 and a drag strap 52 secured about the circumference of the flywheel 51.

The exercise apparatus 20 further includes a post 60 that is mounted relative to the base 30 and extends in a substantially vertical direction from the base 30 when in an operable position. A clip 53 is slidably mounted relative to the post 60 to releasably secure the drag strap 52 relative to the post 60 and thereby set the tension in the drag strap 52 and the corresponding level of resistance to rotation of the flywheel 51.

The skier 20 further includes a pelvis support 70 that is slidably secured relative to the post 60. The pelvis support 70 is designed to support the hips of a person using the apparatus 20, and the elevation of the pelvis support 70 is adjustable along the post 60 to accommodate persons of various heights. A bar 80 is mounted relative to the post 70 and extends in a forward and upward direction from the post 70 when in an operable position, defining an angle of approximately 130 degrees therebetween. A pair of fixed handles 81*a* and 81*b* extend laterally from opposite sides of the bar 80.

An arm exercise unit 90 is secured relative to a distal end of the bar 80. The arm exercise unit 90 includes a pair of flexible lines 91*a* and 91*b* that are designed to be pulled from a drum 93 in reciprocating fashion, subject to a frictional resistance force. A pair of free handles 92*a* and 92*b* are disposed on respective distal ends of the pair of lines 91*a* and 91*b*.

In operating the skier 20 shown in FIG. 1, a person faces toward the pelvis support 70, places a foot on each of the skis 40*a* and 40*b*, and leans forward slightly to rest his or her pelvis or hips against the pelvis support 70. The person may additionally grasp a free handle 92*a* or 92*b* in each hand or simply hold onto the sides of the pelvis support 70 or the fixed handles 81*a* and 81*b*. The person then "shuffles" his or her feet back and forth, alternately pushing one of the skis 40*a* and 40*b* rearward against the resistance from the flywheel and pulling the other of the skis 40*a* and 40*b* forward subject to minimal resistance. The person also has the option of alternately pulling one of the free handles 92*a* and 92*b* rearward against the resistance from the drum and having the other of the free handles 92*a* and 92*b* reciprocally pulled forward.

A training belt 100 is releasably secured relative to the pelvis support 70 for persons who may otherwise be tentative or unsuccessful in first using the cross-country skier 20. The belt 100 is designed to wrap around the posterior or buttocks of such persons to hold them firmly in contact with the pelvis support 70 and thereby eliminate a potential distraction as they first learn to exercise on the skier 20. The pelvis support 70 provides a means for bracing the person's pelvis, particularly during rearward thrust of the skis, and the belt 100 provides a means for capturing the person's pelvis against the "brace" or pelvis support 70.

Figure 2:
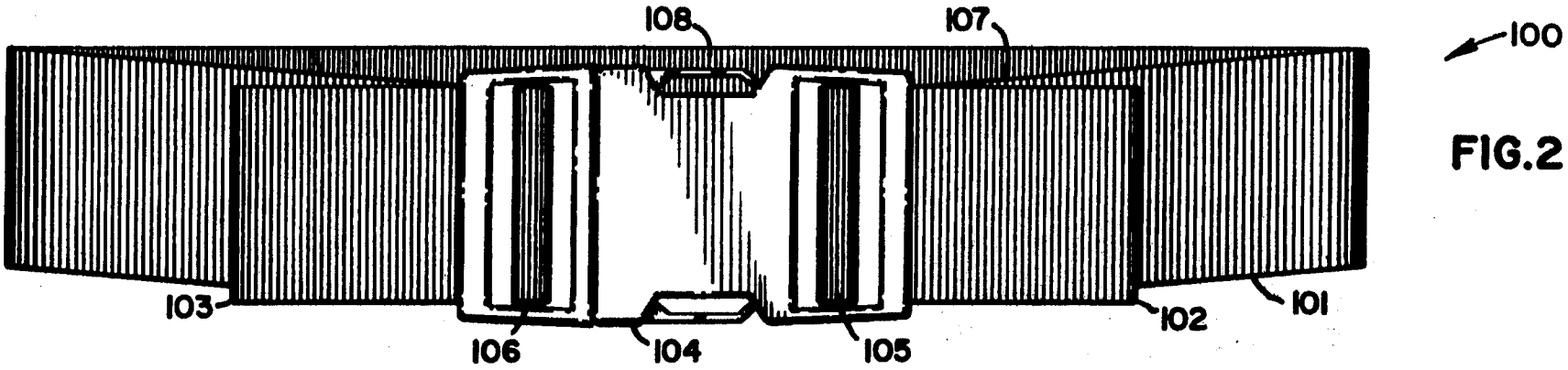
FIG. 2 is a perspective view of a preferred embodiment pelvis stabilizing belt forming a part of the cross-country skiing exercise apparatus shown in FIG. 1.

The belt 100 is shown in detail in FIG. 2. The belt 100 includes a nylon strap 101 that extends from a first end 102 to a second end 103. A buckle 104 secures the ends 102 and 103 relative to one another to form the strap 101 into a loop. The first end 102 passes around and is secured relative to a first rod 105 on the buckle 104, and the second end 103 passes around and is secured relative to a second rod 106 on the buckle 104. A first or front portion 107 of the belt 100, which preferably includes the buckle 104, is releasably secured to the pelvis support 70 in the manner shown in FIG. 1. In particular, the pelvis support 70 includes a neck member 71 that extends between the post 60 and a foam based pad 72, and the front portion 107 passes over the top and around the sides of the relatively thin neck member 71 and beneath the relatively wide pad 72. The connection is secure because the pad member 72 is approximately twelve inches wide, and the neck member 71 is only one inch wide.

A second or rear portion 108 of the belt 100, which is preferably opposite the buckle 104, engages the posterior of a person using the cross-country skiing exercise apparatus 20. In other words, the belt or loop 100 effectively surrounds the person's pelvis and some portion of the pelvis support 70. The person has access to the buckle 104 and can adjust the ends 102 and 103 relative to the rods 105 and 106, respectively, to vary the effective circumference of the belt 100.

Figure 4:
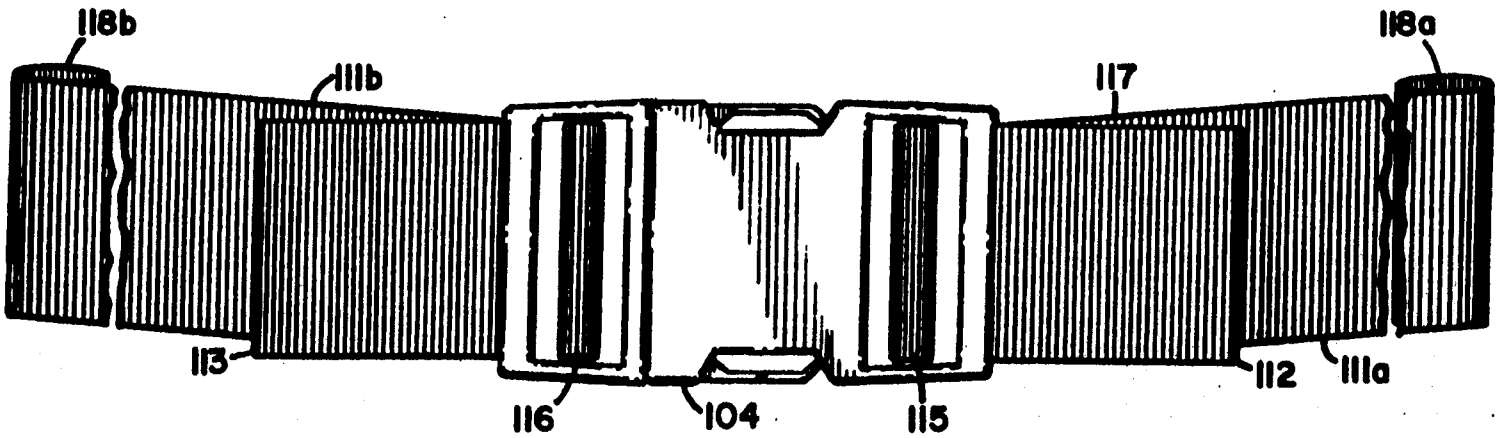
FIG. 4 is a perspective view of an alternative embodiment pelvis stabilizing belt forming a part of the cross-country skiing exercise apparatus shown in FIG. 3.
Figure 3:
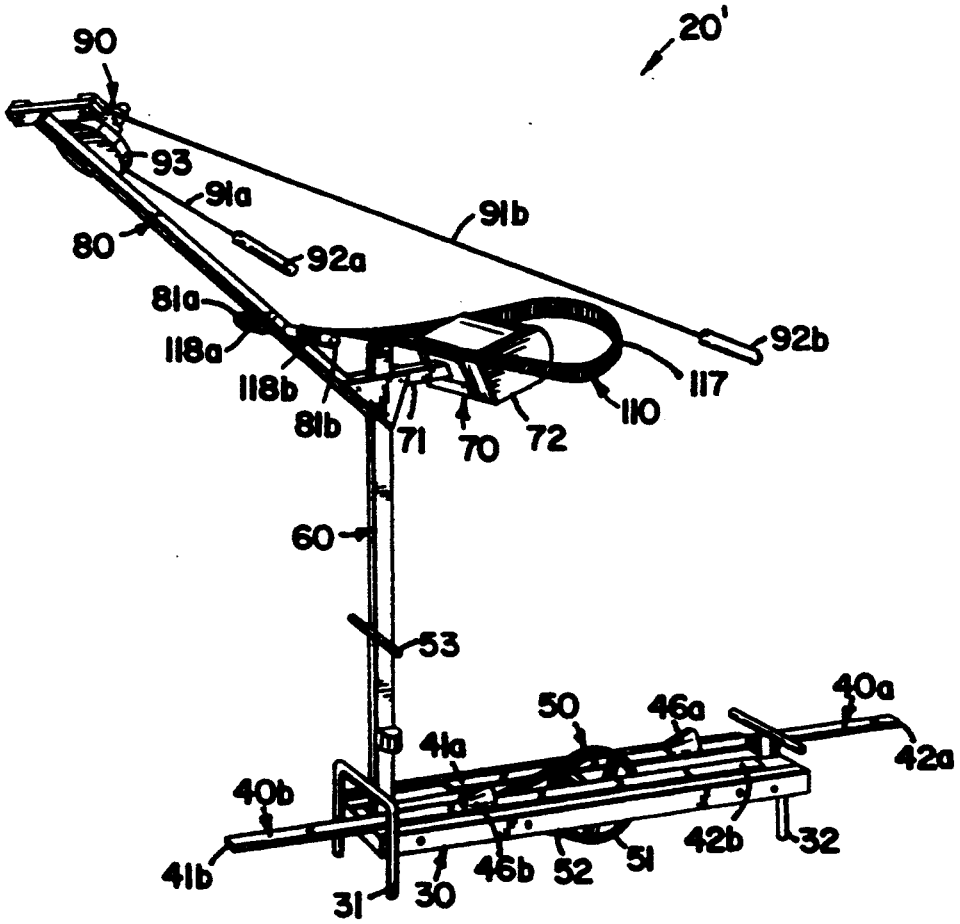
FIG. 3 is a perspective view of an alternative embodiment cross-country skiing exercise apparatus constructed according to the principles of the present invention.

An alternative embodiment skier 20' is shown in FIG. 3. The skier 20' is similar in all respects to the preferred embodiment skier 20 shown in FIG. 1, except that an alternative embodiment belt 110 has been substituted for the preferred embodiment belt 100. The alternative embodiment belt 110 is shown in detail in FIG. 4. The belt 110 includes a pair of straps 111*a* and 111*b* that are secured relative to one another by a buckle 114. The first strap 111*a* extends from a first end 112 to a second, looped end 118*a*, and the first end 112 passes around and is secured relative to a first rod 115 on the buckle 114. The second strap 111*b* extends from a first end 113 to a second, looped end 118*b*, and the first end 113 passes around and is secured relative to a second rod 116 on the buckle 114.

An intermediate portion 117 which ordinarily would include the buckle 114, of the belt 110, engages the posterior of a person standing on the skis 40*a* and 40*b*, and the looped ends 118*a* and 118*b* slide onto the laterally extending, fixed handles 81*a* and 81*b*, respectively. The ends 112 and 113 are adjusted relative to the buckle 114 to vary the effective circumference of the belt 110 and securely yet comfortably hold the person's pelvis against the pelvis support 70. The "sides" of the belt 110 may extend around the pelvis support 70 as shown in FIG. 3, or they may pass beneath the pelvis support 70 in a manner similar to that shown in FIG. 1. In any event, the belt 110 operates in a similar manner and serves the same function as the belt 100 described above.

The present invention also provides a method of learning how to exercise on a cross-country skiing exercise apparatus such as those shown in FIGS. 1 and 3. One portion of the strap is secured about the person's pelvis, and another portion of the strap is secured relative to the cross-country skiing exercise apparatus proximate the pelvis support to hold the person's pelvis against the pelvis support. An optional step involves holding on to the pair of fixed handles which extend laterally at a height above the pelvis support.

With respect to the skier 20 shown in FIG. 1, the step of securing the another portion 107 of the strap 101 involves securing the another portion 107 of the strap 101 about an effective portion of the pelvis support 70. With respect to the skier 20' shown in FIG. 3, the step of securing the another portion 108 of the strap 101 involves securing opposite ends 118*a* and 118*b* of the strap 111 to the pair of fixed handles 81*a* and 81*b*.

Although the present invention has been described with respect to specific embodiments, those skilled in the art will recognize additional modifications and applications that fall within the scope of the present invention. Also, those skilled in the art will recognize that the present invention is not limited to the specific skiers shown in FIGS. 1 and 3. Thus, the present invention is to be limited only by the appended claims.

What is claimed is:

1. A striding exercise apparatus, comprising:

a frame designed to rest upon a floor surface;

a pair of foot members movably mounted relative to said frame;

a pelvis support mounted relative to said frame to support the pelvis of a person standing on said pair of foot members;

a pair of fixed handles mounted on said frame proximate said pelvis support; and a belt including two belt segments, each of said segments having a looped end designed to mount on one of said pair of fixed handles, and a portion extending away from said looped end to a common connector that adjustably interconnects each said portion to hold the person's pelvis against said pelvis support.

2. A striding exercise apparatus according to claim 1, wherein said foot members move in a substantially horizontal plane.

3. A striding exercise apparatus according to claim 2, wherein said pelvis support is slidably mounted relative to a substantially vertical post that extends upward from said frame.

4. A striding exercise apparatus according to claim 3, further comprising an arm exerciser mounted on a bar connected to said substantially vertical post and extending in a direction upward and forward away from a user of the striding exercise apparatus.

5. A striding exercise apparatus according to claim 3, wherein said arm exerciser includes a pair of free handles secured by respective flexible lines to a drum, and said free handles are designed to mount on said fixed handles when not in use.

6. A striding exercise apparatus, comprising:

a frame designed to rest upon a floor surface;

a pair of foot members movably mounted relative to said frame;

a pelvis support mounted relative to said frame to support the pelvis of a person standing on said pair of foot members;

a pair of fixed handles mounted on said frame proximate said pelvis support;

a first belt segment having a first, looped end designed to mount on one of said pair of fixed handles, and a second end; and a second belt segment having a first, looped end designed to mount on another of said pair of fixed handles, and a second end; and an adjustable attachment means for attaching said second end of said first belt segment to said second end of said second belt segment and adjustably capturing a person's pelvis against said pelvis support.

7. A striding exercise apparatus according to claim 6, wherein said adjustable attachment means is a buckle.

8. A striding exercise apparatus according to claim 7, wherein said buckle is slideably mounted on said first belt segment.

9. A striding exercise apparatus according to claim 8, wherein said buckle is slideably mounted on said second belt segment.

* * * * *